US008764330B2

(12) United States Patent
Bauer et al.

(10) Patent No.: US 8,764,330 B2
(45) Date of Patent: Jul. 1, 2014

(54) PENCIL, IN PARTICULAR A COSMETIC PENCIL

(75) Inventors: Reinhard Bauer, Rosstal (DE); Lutz Braeuer, Igensdorf (DE); Rainer Gaebler, Uttenreuth (DE); Norbert Poetschl, Forchheim (DE); Andreas Weber, Heroldsberg (DE); Clemens Wiesmann, Heroldsberg (DE)

(73) Assignee: Schwan-STABILO Cosmetics GmbH & Co. KG, Heroldsberg (DE)

( * ) Notice: Subject to any disclaimer, the term of this patent is extended or adjusted under 35 U.S.C. 154(b) by 422 days.

(21) Appl. No.: 13/318,374

(22) PCT Filed: Aug. 2, 2010

(86) PCT No.: PCT/EP2010/004721
§ 371 (c)(1),
(2), (4) Date: Nov. 1, 2011

(87) PCT Pub. No.: WO2011/020553
PCT Pub. Date: Feb. 24, 2011

(65) Prior Publication Data

US 2012/0045267 A1 Feb. 23, 2012

(30) Foreign Application Priority Data

Aug. 17, 2009 (DE) ..... 20 2009 011 179

(51) Int. Cl.
*B43K 29/06* (2006.01)

(52) U.S. Cl.
USPC ..... 401/50; 401/51

(58) Field of Classification Search
CPC ..... A45D 40/20; A45D 2040/20; A45D 2040/202; A45D 2040/205; A45D 2040/208
USPC ..... 401/50, 51, 65, 66, 67
See application file for complete search history.

(56) References Cited

U.S. PATENT DOCUMENTS

| | | | | |
|---|---|---|---|---|
| 2,507,089 | A | 5/1950 | Bridges et al. | |
| 2,907,301 | A | 10/1959 | Spatz | |
| 3,101,074 | A * | 8/1963 | Spatz | 401/51 |
| 3,232,276 | A * | 2/1966 | Kupersmith et al. | 401/51 |
| 3,768,915 | A * | 10/1973 | Spatz | 401/50 |
| 5,366,311 | A | 11/1994 | Powers | |
| 2006/0222446 | A1 | 10/2006 | Biegel | |
| 2007/0031176 | A1 | 2/2007 | Gieux | |
| 2009/0129849 | A1 * | 5/2009 | Schmidt et al. | 401/50 |
| 2009/0129850 | A1 * | 5/2009 | Schmidt et al. | 401/50 |

FOREIGN PATENT DOCUMENTS

| | | | |
|---|---|---|---|
| DE | 59573 | C | 11/1981 |
| DE | 19616613 | C1 | 10/1997 |
| DE | 102007053786 | B3 | 2/2009 |

(Continued)

*Primary Examiner* — David Walczak
*Assistant Examiner* — Jennifer C Chiang
(74) *Attorney, Agent, or Firm* — Bachman & LaPointe, P.C.

(57) ABSTRACT

A pencil, in particular a cosmetic pencil, comprising a cartridge, a lead held such that it can move axially relative to the cartridge, and a shaper for shaping the working end of the lead. The pencil can adopt an operating state in which twisting of the shaper relative to the lead and/or the cartridge in a first angle of rotation section leads to axial displacement of the cartridge relative to the lead in the direction away from the shaper, and in a second angle of rotation section leads to axial displacement of the lead in the direction towards the shaper.

13 Claims, 5 Drawing Sheets

(56) References Cited

FOREIGN PATENT DOCUMENTS

| | | | |
|---|---|---|---|
| DE | 202007015726 | U1 | 3/2009 |
| FR | 1209213 | A | 2/1960 |
| JP | 63175517 | U | 11/1988 |
| JP | 2002119330 | A | 4/2002 |

* cited by examiner 34
42
12
14
24
10
32
40
30
26

PENCIL, IN PARTICULAR A COSMETIC PENCIL

BACKGROUND OF THE INVENTION

The invention relates to a pencil, in particular a cosmetic pencil, comprising a cartridge, a lead held such that it can move axially relative to the cartridge, and a shaper for shaping the working end of the lead.

Pencils of the type specified at the start are known, for example from U.S. Pat. No. 2,907,301. With the known pencil, when the shaper is attached a taut spring, which in the released state presses a lead carrier with a lead against the shaper, is released. With the pencil according to DE 196 16 613 C1 the lead is pressed by means of a spindle drive against the shaper, a sliding coupling being provided in order to limit the force with which the lead is pressed against the shaper.

The known pencils are not satisfactory, in particular with regard to the result of the shaping by means of the shaper.

It is the object of the invention to further develop the pencil of the type specified at the start such that it works satisfactorily, in particular with regard to the result of the shaping.

SUMMARY OF THE INVENTION

According to the invention the object set with a pencil of the type specified at the start is achieved in that the pencil can adopt an operating state in which twisting of the shaper relative to the lead and/or the cartridge in a first angle of rotation section leads to axial displacement of the cartridge relative to the lead in the direction away from the shaper, and in a second angle of rotation section leads to axial displacement of the lead in the direction towards the shaper.

The pencil according to the invention is satisfactory, in particular with regard to the shaping result. This can first and foremost be put down to the fact that within the framework of the solution according to the invention, in particular in the second angle of rotation section, an exactly defined lead feed rate can be specified precisely on the working side so that the feed rate of the lead is harmonised with the shaping by means of the shaper, by means of which excessive demands upon the lead are avoided.

It is preferred according to the invention if twisting of the shaper relative to the lead and/or the cartridge in the second angle of rotation section leads to axial displacement of the cartridge together with the lead towards the shaper.

In this way it is achieved that the lead does not also have to be shifted within the cartridge during the actual shaping. In this way demands upon the lead are further reduced.

It is further preferred according to the invention if the shaper is coupled in at least one operating state to the cartridge by means of a control curve.

With this type of control curve the cartridge feed rate in particular can be precisely specified when shaping.

Preferably, an elastic device is provided for pre-tensioning the cartridge and/or the lead in the direction towards the shaper.

In this way a solution which is particularly simple from a mechanical point of view is found.

According to the invention, it is further preferred if the shaper is accommodated in a protector.

This solution also serves in particular to simplify the overall structure of the pencil.

According to the invention it is preferred if the protector can be screwed on, in particular onto a shaft of the pencil.

A screw connection guarantees particularly reliable attachment of the protector (and optionally of the shaper).

According to a further preferred embodiment of the invention a pitch-free thread turn adjoining a thread turn serving to screw on the protector is provided.

This pitch-free thread turn can be used to produce the aforementioned operating state in which twisting of the shaper relative to the lead and/or the cartridge leads in a first angle of rotation section to axial displacement of the cartridge relative to the lead in the direction away from the shaper, and in a second angle of rotation section to axial displacement of the lead in the direction towards the shaper.

If is further preferred according to the invention if the shaper is a sharpener.

According to a particularly preferred embodiment of the invention the axial displacement of the cartridge relative to the angle of twisting in the first angle of rotation section is greater than the axial displacement of the lead relative to the angle of rotation in the second angle of rotation section.

In this way it is achieved that in the second angle of rotation section assigned to the shaping of the working end of the lead the feed rate of the lead resulting from the twisting of the shaper can be particularly finely metered.

A particularly simple overall structure is produced according to the invention by means of a coupling device which enables axial displacement of the cartridge relative to the lead in the direction away from the shaper, but blocks in the counter-direction.

It is further preferred according to the invention if the coupling device is a catch device coupling the cartridge to a lead plunger.

In particular if the shaper is accommodated within the protector, under certain circumstances one can not see from the outside that twisting of the protector, and so of the shaper, leads to shaping of the lead.

Therefore, provision is made according to one particularly preferred embodiment of the invention such that the pencil can adopt an operating state in which twisting of the shaper relative to the lead and/or the cartridge triggers an acoustic signal.

With this acoustic signal a user is made aware that the aforementioned twisting of the protector leads to shaping of the working end of the lead.

Finally, the invention preferably provides a collecting container for waste resulting from the shaping, in particular in a protector.

BRIEF DESCRIPTION OF THE DRAWINGS

In the following the invention is described more fully with further details by means of a preferred exemplary embodiment with reference to the attached drawings. These show as follows.

DETAILED DESCRIPTION

Figure 1:
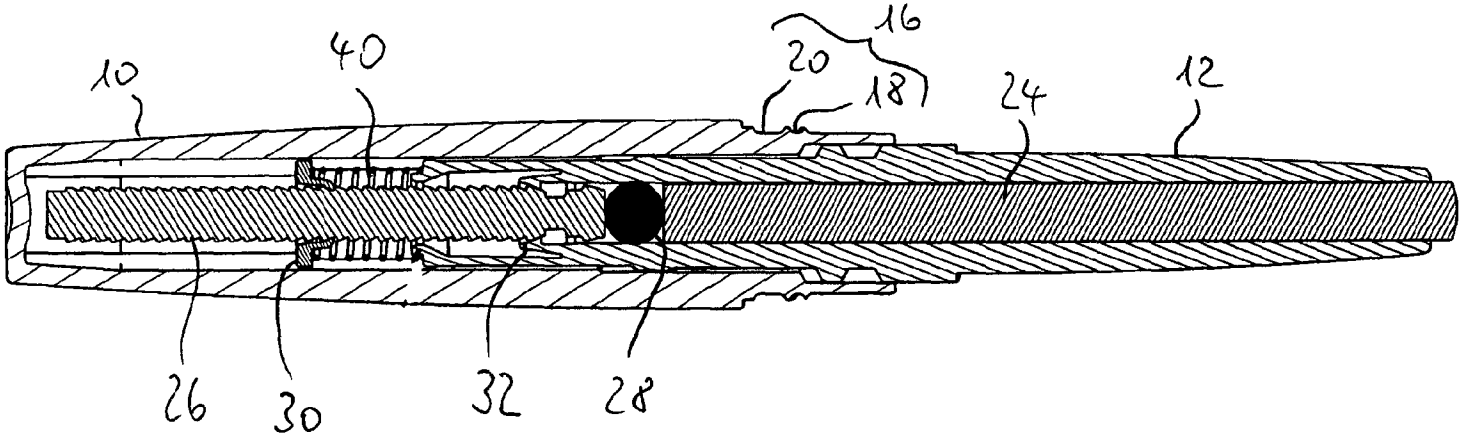
FIG. 1 a schematic longitudinal sectional view of a pencil according to a preferred exemplary embodiment of the invention, FIG. 2 the same view as FIG. 1, but with the protector screwed on, FIG. 3 the same view as FIG. 2, but with the protector twisted by 30°, FIG. 4 the same view as FIG. 3, but with the protector twisted by a further 150°, FIG. 5 the same view as FIG. 1, but with a sharpened lead, FIG. 6 an isometric partial view of the pencil according to FIGS. 1 to 5, FIG. 7 a further isometric partial view of the pencil according to FIGS. 1 to 5, but with a protector, and FIG. 8 yet another isometric partial view of the pencil according to FIGS. 1 to 5, once again with a protector, but in a different operating state to FIG. 7.

The pencil illustrated in the drawing comprises a shaft 10, a cartridge 12 and a protector 14. The shaft 10 has a thread 16 with a pitched thread turn 18 and a pitch-free thread turn 20. The protector 14 has a corresponding thread element 22.

A lead 24 is introduced into the cartridge, preferably by pouring. In order to move the lead 24 forwards within the cartridge 12 a plunger 26 is used which can act on the lead 24 by means of a ball 28. The plunger 26 is toothed or in the form of a spindle (with an external thread). It co-operates with two catch devices 30, 32.

The protector is provided with a shaper in the form of a sharpener 34. The sharpener 34 lies within the protector 14. Formed on the protector 14 is a bar 36 which, in a way described in detail below, interacts with a control curve 38 of the cartridge 12.

Figure 2:
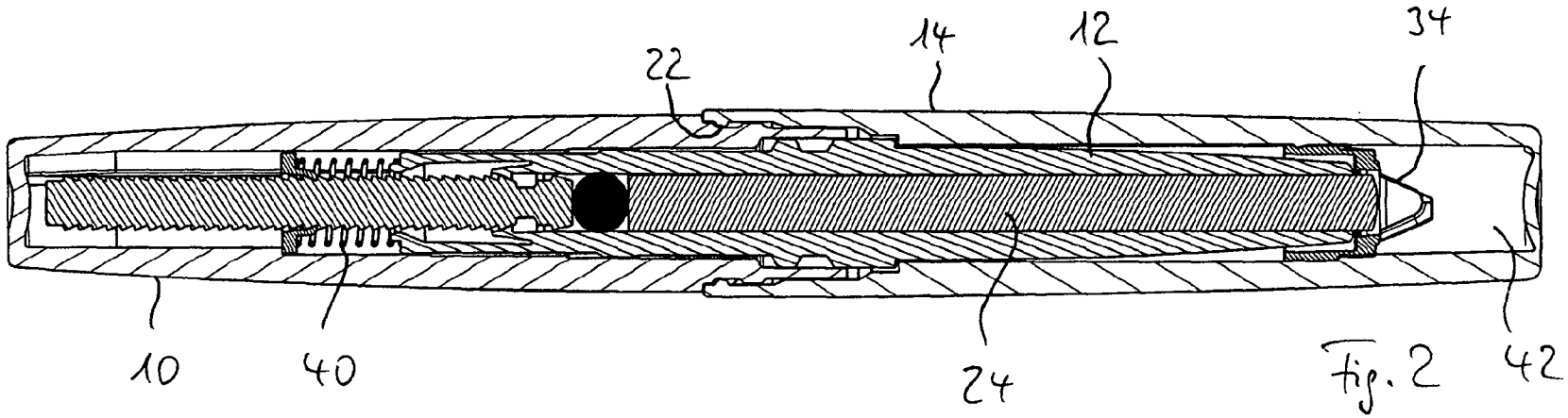
Figure 7:
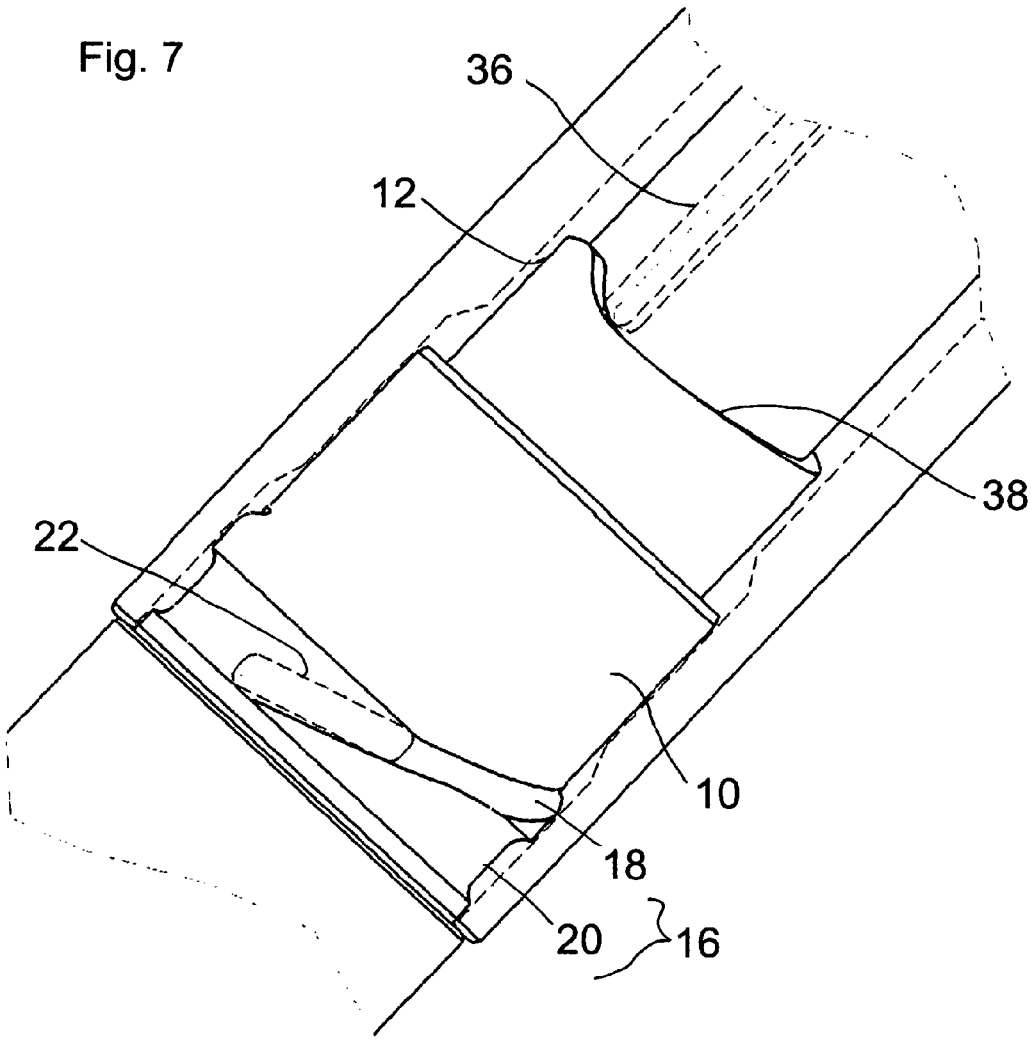
Figure 8:
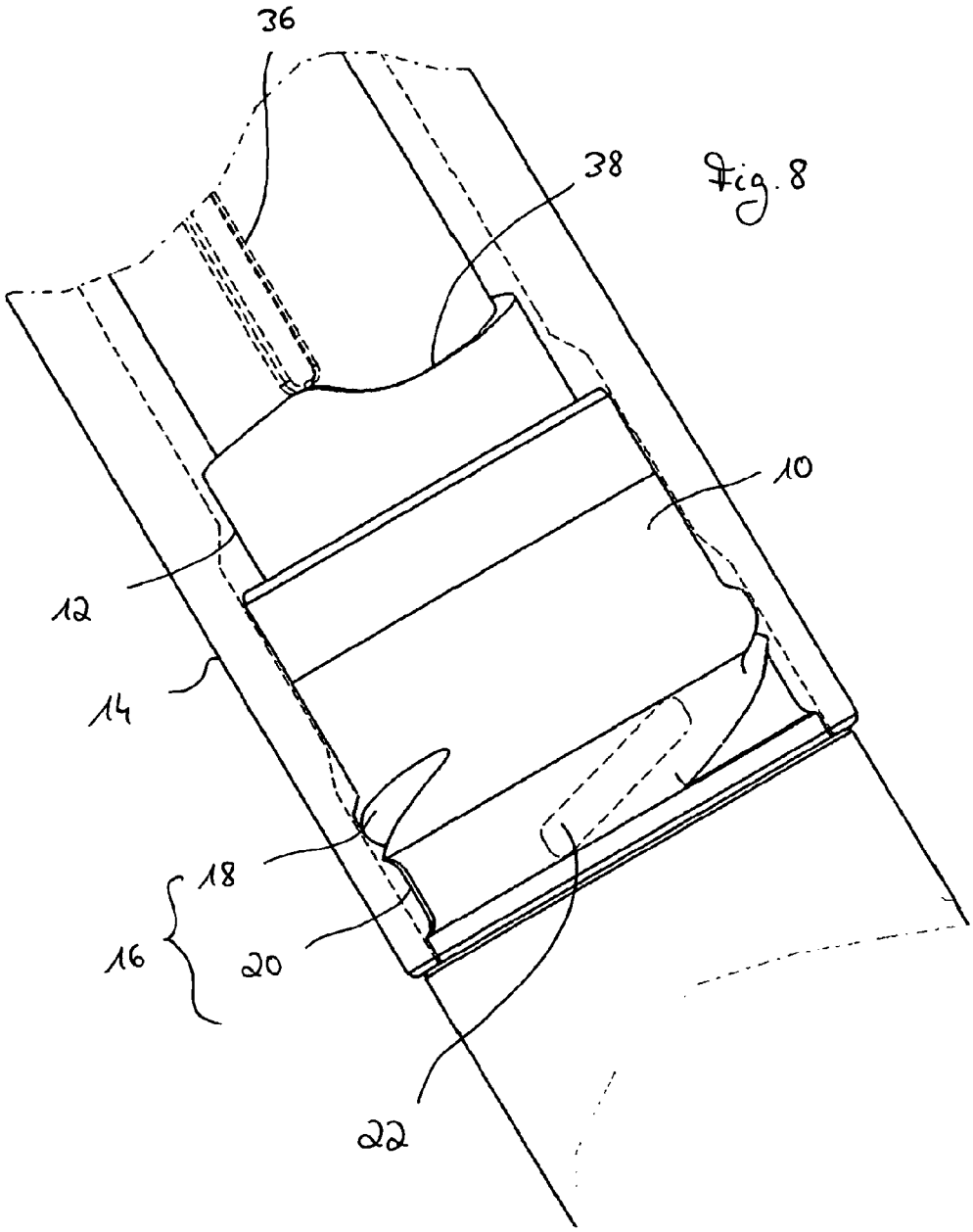

The function of the pencil shown in the drawings is as follows:

It is assumed that the lead 24 of the pencil has become blunt through use, as shown in FIG. 1. In such a case, according to FIG. 2 the protector 14 is placed over the shaft 10 and screwed on by twisting. FIGS. 2 and 7 show a state in which the thread element 22 is located in the pitch-free thread turn 20. The rotational position here is such so that the bar 36 according to FIG. 7 lies in a "valley" of the control curve 38. If the protector 14 is now twisted further relative to the shaft 10, the bar 36 moves up a "hill" of the control curve 38 until the operating state according to FIGS. 3 and 8 is reached. In this operating state the bar 36 has displaced the cartridge 12 in the direction away from the sharpener 34, i.e. to the left in FIGS. 1 to 5, because of its upward movement along the control curve 38. This displacement takes place against the elastic reset force of a spring 40. Since upon displacement of the cartridge 12 to the left the catch device 32 does not block, but the plunger 26 is blocked by the catch device 30 from being displaced to the left, the cartridge 12 is displaced to the left, but not the lead 24 which is held in position by the plunger 26.

With further twisting of the protector 14 relative to the shaft 10 the bar 36 passes down again from the "hill" of the control curve 38. In this way the spring 40 can be slackened by displacing the cartridge 12 back to the right, i.e. towards the sharpener 34. Since in this case the catch device 32 blocks, but the catch device 30 does not block, the plunger 26, and so the lead 24 together with the cartridge 12, moves to the right, i.e. towards the sharpener 34. Since at the same time the sharpener 34 is twisted together with the protector 14 relative to the lead 24, the lead is sharpened, as shown schematically in FIG. 4. The sharpening waste is collected here in the interior 42 of the protector 14.

Figures 2, 4, 5:
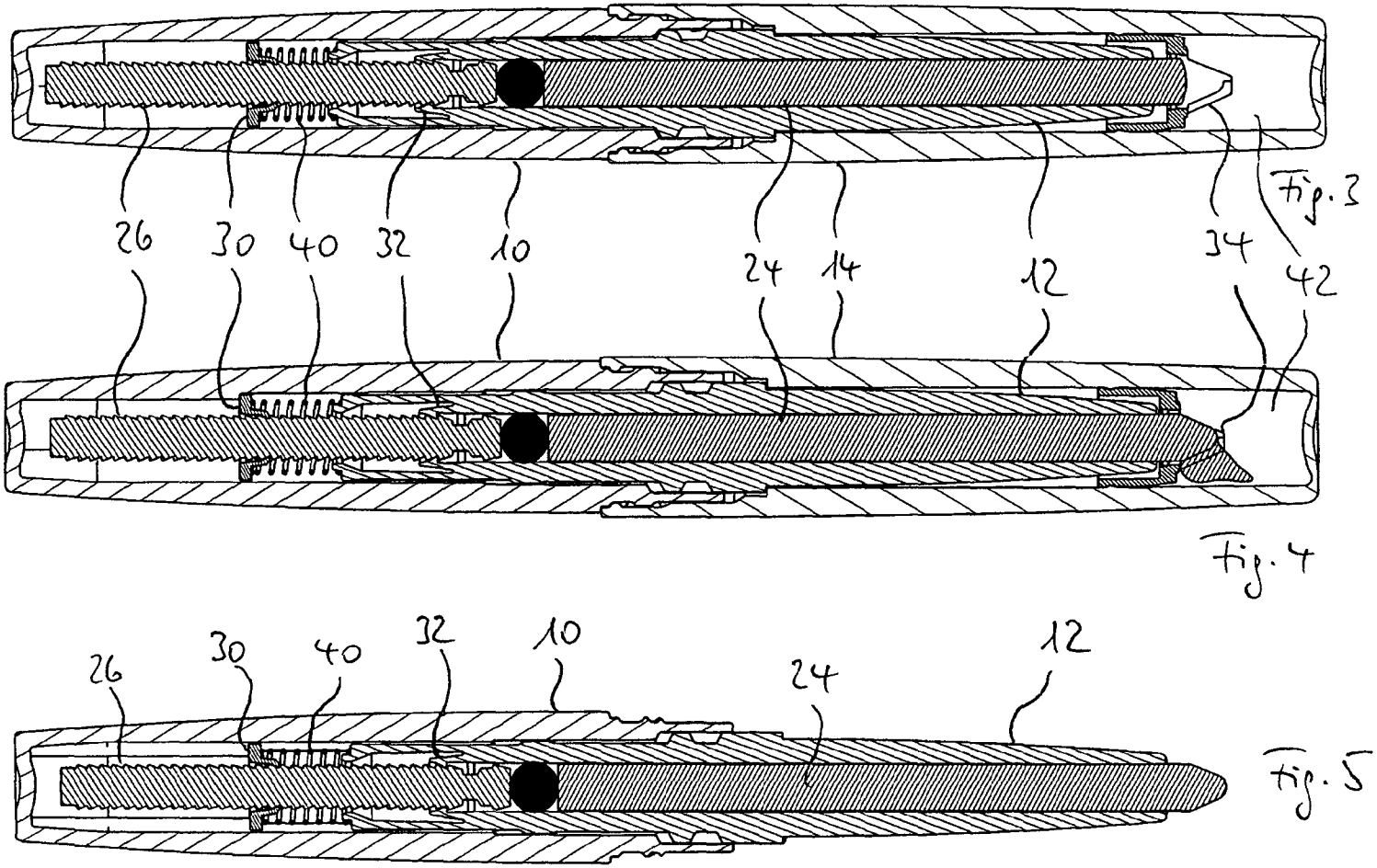
Figure 6:
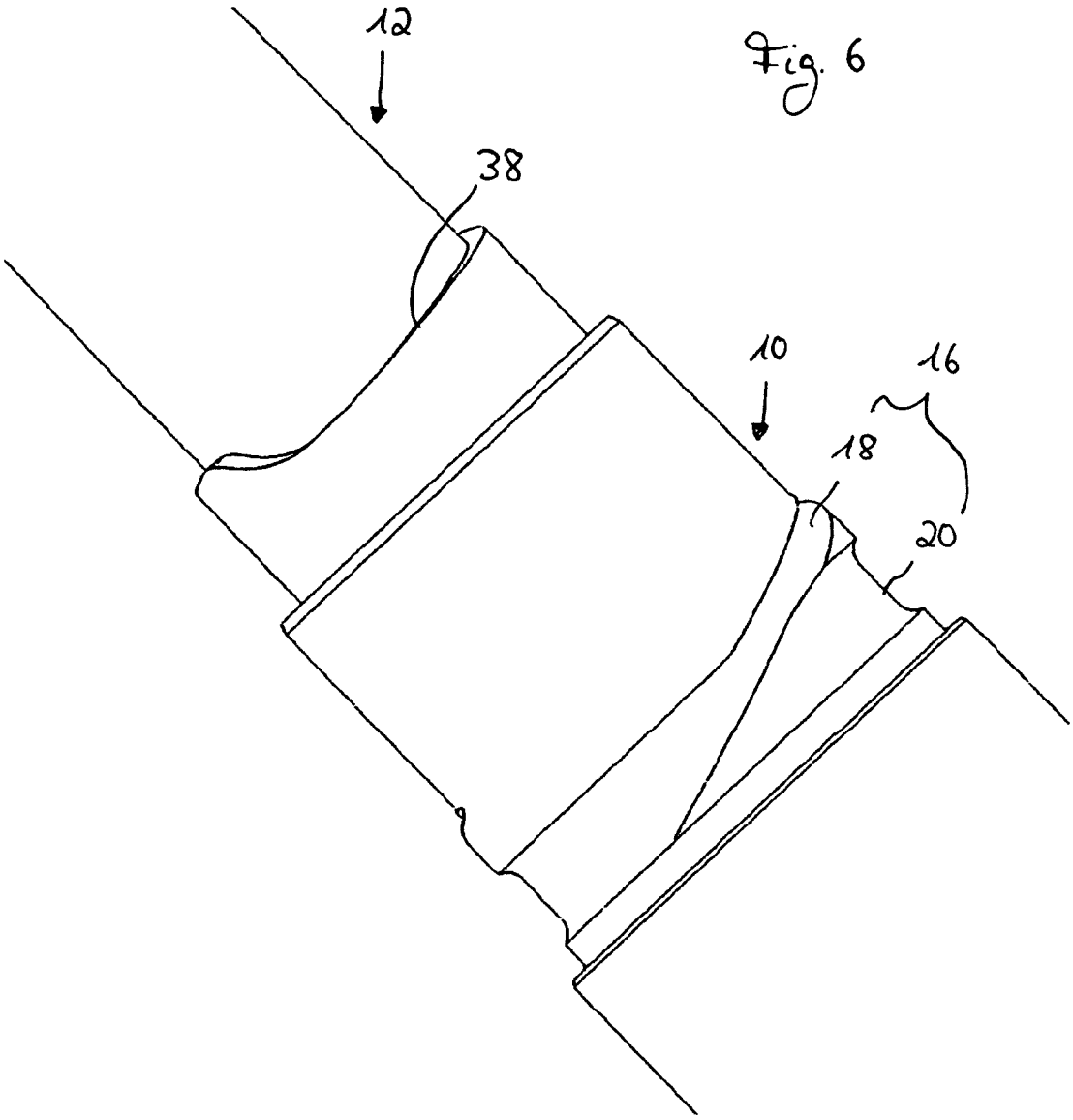

If the protector 14 is unscrewed from the shaft 10 again after sharpening the lead 24, the state according to FIG. 5 is achieved which corresponds to that of FIG. 1, but with a sharpened lead 24.

As shown by the explanations above, with the exemplary embodiment of the invention shown in the drawing, the sharpener 34 is coupled by the protector 14 and the bar of the latter 36 to the control curve 38 of the cartridge 12. If the sharpener 34 is twisted by turning the protector 14 relative to the lead 24 in order to sharpen the latter, the bar 36 slides on the control curve 38. A connection is thus produced between the sharpening by twisting the sharpener 34 and the axial displacement of the cartridge 12 with the lead 24 located within the latter.

Although this is not shown in the drawing, a further device can be provided which produces a clicking noise or similar when the lead 24 is sharpened by twisting the protector 14 relative to the shaft 10 in order to indicate that sharpening is taking place. In this way undesired sharpening due to continuous twisting of the protector 14 relative to the shaft 10 can be prevented. The aforementioned clicking noise can then always be heard, and this makes one aware of the sharpening.

The features of the invention disclosed in the above description, the claims and the drawings can be essential both individually and in any combination in order to realise the invention in its different embodiments.

The invention claimed is:

1. A pencil comprising:

a cartridge (12), a lead (24) located at least partially within the cartridge and axially movable relative thereto, a rotatable shaper (34) for shaping the working end of the lead, wherein the pencil can adopt an operating state wherein rotation of the shaper relative to the lead and/or the cartridge in a first angle of rotation section leads to axial displacement of the cartridge relative to the lead in a direction away from the shaper, and in a second angle of rotation section leads to axial displacement of the lead in a direction towards the shaper.

2. The pencil according to claim 1, wherein the twisting of the shaper (34) relative to the lead (24) and/or the cartridge (12) in the second angle of rotation leads to axial displacement of the cartridge together with the lead towards the shaper.

3. The pencil according to claim 1, wherein the shaper (34) is coupled in at least one operating state to the cartridge (12) by a control curve (38).

4. The pencil according to claim 1, further including an elastic device (40) for pre-tensioning the cartridge (12) and/or the lead (24) in the direction towards the shaper (34).

5. The pencil according to claim 1, wherein the shaper (34) is accommodated in a protector (14).

6. The pencil according to claim 5, wherein the protector (14) can be screwed onto a shaft (10) of the pencil.

7. The pencil according to claim 6, wherein a pitch-free thread turn (20) on the shaft (10) adjoins a thread turn (18) on the shaft (10) serving to screw on the protector (14).

8. The pencil according to claim 5, wherein the shaper (34) is a sharpener.

9. The pencil according to claim 1, wherein the axial displacement of the cartridge (12) relative to the angle of twisting in the first angle of rotation section is greater than the axial displacement of the lead (24) relative to the angle of rotation in the second angle of rotation section.

10. The pencil according to claim 1, further including a coupling device (32) which enables axial displacement of the cartridge (12) relative to the lead (24) in the direction away from the shaper (34), but blocks displacement in the direction towards the shaper.

11. The pencil according to claim 10, wherein the coupling device (32) comprises a catch device coupling the cartridge (12) to a lead plunger (26).

12. The pencil according to claim 1, wherein the pencil can adopt an operating state wherein twisting of the shaper (34) relative to the lead (24) and/or the cartridge (12) triggers an acoustic signal.

13. The pencil according to claim 1, further including a collecting container (42) for waste resulting from the shaping located in a protector (14).

* * * * *